United States Patent [19]

Brodie

[11] Patent Number: 4,712,754

[45] Date of Patent: Dec. 15, 1987

[54] ROCK CLIMBING ANCHOR

[76] Inventor: Malcolm J. Brodie, 7975 French Street, Vancouver, British Columbia, Canada, V6P4V8

[21] Appl. No.: 882,422

[22] Filed: Jul. 7, 1986

[51] Int. Cl.[4] ..... F16M 13/00

[52] U.S. Cl. ..... 248/1; 248/200

[58] Field of Search ..... 248/1, 200, 231.9; 182/5; 411/340, 341, 342, 343, 344, 345, 346; 24/608, 611

[56] References Cited

U.S. PATENT DOCUMENTS

| | | | |
|---|---|---|---|
| 3,877,679 | 4/1975 | Lowe | 254/135 |
| 3,903,785 | 9/1975 | Pepper, Jr. | 85/79 |
| 3,946,975 | 3/1976 | Lyman, Jr. | 248/1 |
| 3,948,485 | 4/1976 | Chouinard et al. | 248/1 |
| 3,957,237 | 5/1976 | Campbell | 248/1 |
| 4,044,976 | 8/1977 | Campbell | 248/1 |
| 4,069,991 | 1/1978 | Saunders et al. | 248/1 |
| 4,074,880 | 2/1978 | Simond | 248/1 |
| 4,082,241 | 4/1978 | Burkey | 248/1 |
| 4,083,521 | 4/1978 | Greiner | 248/1 |
| 4,184,657 | 1/1980 | Jardine | 248/1 |
| 4,422,607 | 12/1983 | Vallance | 248/1 |
| 4,491,291 | 1/1985 | Ching | 248/1 |
| 4,565,342 | 1/1986 | Grow | 248/1 |

FOREIGN PATENT DOCUMENTS

| | | | |
|---|---|---|---|
| 0047232 | 3/1982 | European Pat. Off. . | |
| 2153952 | 8/1985 | United Kingdom | 182/5 |

OTHER PUBLICATIONS

High Magazine, Sep. 1985, pp. 56 and 57.

Summit Magazine, Mar./Apr. 1985, p. 30.

*Primary Examiner*—J. Franklin Foss
*Assistant Examiner*—David L. Talbott
*Attorney, Agent, or Firm*—Carver & Co.

[57] ABSTRACT

The invention is an anchoring device for releasably anchoring within a crack in a rock face, the crack having a pair of opposed crack walls. The device has a cam member, a load cable, and expansion and retraction structure. The cam member has convexly curved cam surfaces which contact respective walls of the crack. An inner end portion of the load cable cooperates with the cam member, and an outer end portion of the cable has a loop to cooperate with a separate link or rope. An intermediate portion of the cable cooperates with shoulders of the cam member in such a manner as to rotate the cam member in first direction when the cable is pulled. This increases force acting on the crack walls and augments retention of the device within the crack. The expansion structure automatically rotates the cam member in the first direction, thus tending to initiate retention of the device within the crack. The retraction structure rotates the cam member in a second direction, opposite to the first direction, so as to decrease force on the crack walls, thus facilitating removal of the device from the crack. The invention provides a simple mechanical device which is easy to insert and remove from the crack and is particularly adapted for fitting within cracks having essentially parallel crack walls. The device is relatively insensitive to off-axis forces, which are prone to damage some prior art structures having rigid load carrying members.

20 Claims, 9 Drawing Figures

ROCK CLIMBING ANCHOR

BACKGROUND OF THE INVENTION

1. Field of the Invention

The invention relates to an anchoring device for releasably anchoring within a crack in a rock face, particularly adapted for, but not limited to, use by rock climbers.

2. Prior Art

There are many anchoring devices used by rock climbers to secure themselves, or equipment, in a crack of a rock face. Relatively simple anchors are shown in U.S. Pat. Nos. 3,948,485 (Chouinard et al) and 4,069,991 (Saunders et al). These devices show an irregular shaped wedge type member connected to a loop sling and adapted to be inserted within a tapering crack. The loop sling cooperates with the device in such a way as to apply a torque or twisting motion to the device when the sling is loaded. This twisting or rotation presents a device of increasing effective size within the crack, which tends to augment gripping the device as the load is increased. While this type of simple device is effective in outwardly tapered cracks, it can be difficult to remove when subjected to high loading, which could occur when a climber falls. Also, sometimes a simple wedge-type device can be accidentally pulled from cracks by the climbing rope.

The tendency of the device to present a larger size as it rotates can be referred to as "expansion ratio", which is a measure of the range of crack sizes with which the device can be used. Clearly, the greater the expansion ratio, the fewer the number of anchoring devices a climber would have to carry in order to accommodate a particular range of crack sizes. Consequently, any improvement that increases the expansion ratio of an anchoring device is a worthwhile consideration.

A more complex type of anchoring device is shown in U.S. Pat. No. 4,184,657 (Jardine) which consists of four hinged cams carried on a common spindle journalled on a rigid load bearing member. The cams are forced to rotate by springs which increase the effective size of the device, i.e., the springs expand the device to fit snugly in the crack. To remove the device from the crack, force on the springs is overcome by a retracting means. In general, these devices have a relatively wide expansion ratio, and usually they can be retrieved from the crack without much difficulty. However, when the cams are fully retracted and fitted within a crack of minimum width they can be difficult to retrieve. Also, when subjected to a rocking motion laterally within the crack, for example due to swinging of a rope, they are known to "walk" into the crack, increasing the difficulty of removal. Also, the devices are relatively complex, and have been known to fail when subjected to off-axis loads due to bending and subsequent breaking of the rigid load bearing member. European patent publication No. 0 047 232 (Meligard) discloses an anchoring device using a pair of wedges which are controlled by flexible rods, with a spring means acting between the rods to cause relative axial movement between the wedges, augmenting gripping of the device within the crack. This is a relatively simple device when compared with the previously described hinged cam member, but it is considered that it has a relatively low expansion ratio when compared with rotating cam devices. Furthermore, the wedges have a relatively large area in contact with the rock, and thus might be prone to misalignment when fitted in an irregular surfaced crack.

SUMMARY OF THE INVENTION

The invention reduces difficulties and disadvantages of the prior art by providing an anchoring device for rock climbers which is mechanically relatively simple and has a relatively wide expansion ratio and thus one sample of the invention can accommodate a relatively wide range of crack sizes. Furthermore, the invention is easy to insert within a crack with one hand, and, under most circumstances, is relatively easy to retrieve from the crack. The device contacts side walls of the crack in a relatively small area, and thus is tolerant to irregular surfaced cracks having outwardly tapering walls, parallel walls, or slightly outwardly flaring walls. Furthermore, the load is applied to the device through a flexible cable or link, which is far more tolerant to off axis loads than a stiff load bearing member of some prior art devices. Also the flexible load bearing member can deform to some extent due to lateral swinging of a rope, and this deformation produces less lateral rocking of the device within the crack than the stiff load bearing member of the prior art. Lateral rocking of the device in the crack can dislodge the device, or cause it to "walk" further into the crack, increasing the difficulty of retrieval.

An anchoring device according to the invention is for releasably anchoring within a crack in a rock face, the crack having a pair of oppositely facing crack walls. The device includes a cam member, a load cable, expansion means and retraction means. The cam member has first and second convexly curved cam surfaces adapted to contact respective walls of the crack. The cam member has shoulder means and cable securing means. The load cable has an inner end portion cooperating with the cable securing means and an outer end portion adapted to cooperate with a separate link. The load cable has an intermediate portion disposed between the inner and outer end portions and cooperating with the shoulder means in such a manner as to rotate the cam member in a first direction when the cable is pulled so as to increase force acting on the crack walls. The inner end portion of the cable is located relative to the shoulder means so that the cable is deformed resiliently as the intermediate portion thereof engages at least a portion of the shoulder means. Force from deforming the cable tends to rotate the cam member in the first direction. In this way, forces generated by pulling the cable and deforming the cable over the shoulders rotate the cam in unison so as to augment retention of the device within the crack. The retraction means cooperate with the cam member and the load cable for rotating the cam member in a second direction which is opposite to the first direction, so as to decrease forces on the crack walls, thus facilitating removal of the device from the crack.

In one embodiment the cam member is particularly adapted for use within a crack having first and second, generally parallel opposed crack walls. The first and second convexly curved cam surfaces contact the first and second walls of the crack at first and second contact points respectively. The curved cam surfaces are so shaped that a line connecting the first and second contact points is inclined at a contact angle to a perpendicular line extending generally normally to the crack walls, the angle being essentially constant for all parallel sided cracks which can accept the cam member. The cam member has shoulder means adapted to cooperate with load sustaining means, i.e. the load cable, so as to rotate the cam member when the load sustaining means is loaded in such a direction as to increase forces on the crack walls, so as to retain the device within the crack.

A detailed disclosure following, which relates to drawings, describes a preferred embodiment of the invention which is capable of expression in structure other than that particularly described and illustrated.

DETAILED DISCLOSURE

FIGS. 1 through 4

Figure 1:
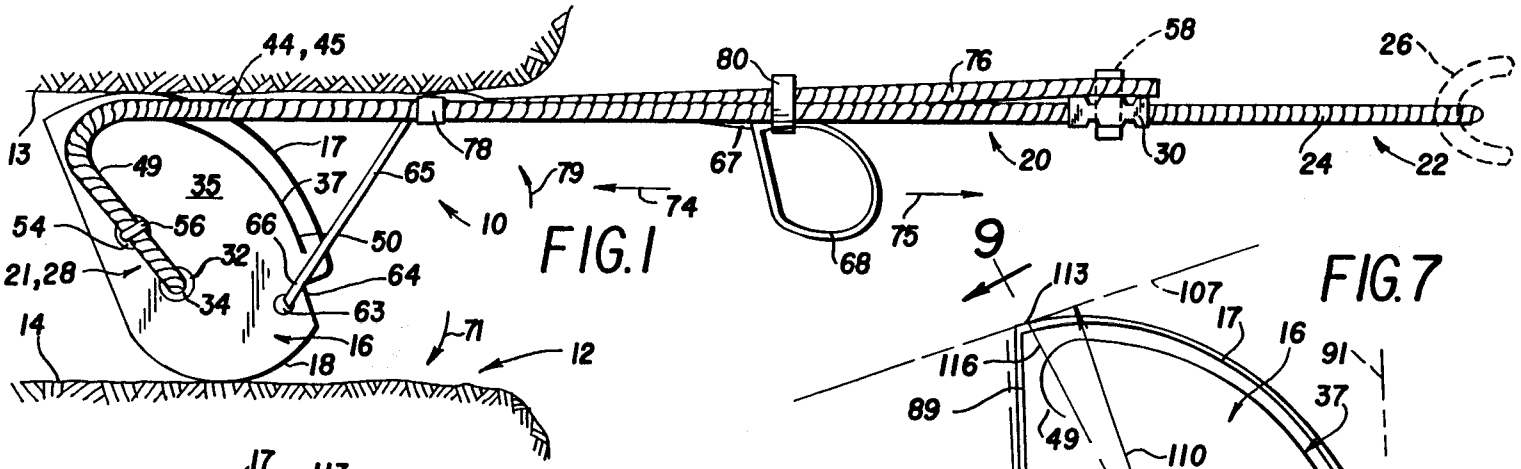
FIG. 1 is a simplified side elevation of a device according to the invention shown inserted within a crack and "partially expanded" so as to cooperate with opposed generally parallel crack side walls.

An anchoring device 10 according to the invention is shown fitted within a crack 12 having first and second, generally parallel, oppositely facing crack walls 13 and 14. The device 10 includes a cam member 16 having first and second convexly curved cam surfaces 17 and 18 which contact the respective first and second walls of the crack as shown in FIG. 1. The device has a load cable 20 which has inner and outer end portions 21 and 22 respectively. The outer end portion has a loop 24, best seen in FIG. 3, which receives a separate link 26, which is typically a snap link or carabiner, or can be a loop of nylon climbing rope or webbing. The inner end portion of the loop 21 is formed into an inner loop 28, the inner and outer loops being secured by a swaged ferrule 30, so that the load cable in fact resembles an elongated figure-of-eight when viewed in a relaxed state. The cam member has a first transverse opening 32 which receives an extreme portion 34 of the inner loop 28 as a free fit within the opening. The opening 32 serves as a cable securing means of the cam member to receive the inner end portion of the cable.

Figures 2, 3, 4, 5, 6:
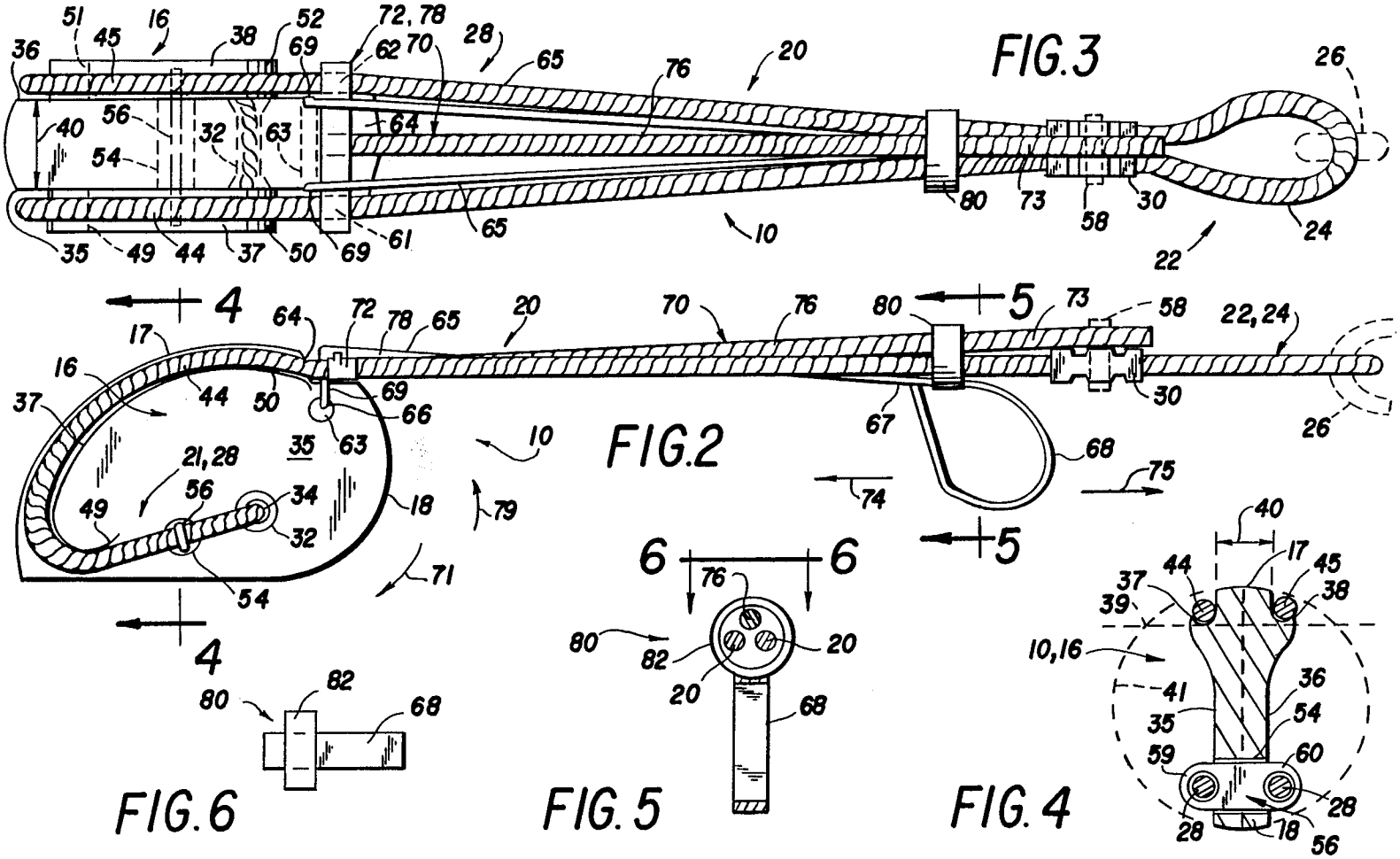
FIG. 2 is a simplified side elevation of the device shown in a "fully retracted" configuration.
FIG. 3 is a simplified top plan view of the device of FIG. 2, shown in the fully retracted configuration.
FIG. 4 is a simplified section on line 4—4 of FIG. 2, showing some geometrical limitations of the device.
FIG. 5 is a simplified fragmented section on line 5—5 of FIG. 2, background detail being omitted.
FIG. 6 is a simplified elevation as seen on line 6—6 of FIG. 5, cables being omitted.

As best seen in FIG. 4, the cam member has first and second generally parallel side faces 35 and 36 and generally similar, curved first and second shoulders 37 and 38 provided on respective opposite side faces of the cam member, and spaced apart at a shoulder spacing 40. The curved shoulders are spaced inwardly from the first cam surface 17, and extend generally parallel to the first cam surface and are adjacent a common intangible geometric surface 39, which is, at any particular point, generally perpendicular to the faces 35 and 36. In other words, the shoulders are spaced equally from an adjacent portion of the cam surface 17, at each position on the cam surface. The first shoulder 37 has first inner and outer ends 49 and 50, and the second shoulder 38 has second inner and outer ends 51 and 52. Both shoulders are generally parallel to the first cam surface and extend essentially the full length of the first cam surface. As best seen in FIG. 4, the cam surfaces 17 and 18 are curved transversely so as to fit within a circle 41 disposed transversely of the side faces at a particular plane of section, in this particular case as seen on line 4—4 of FIG. 2. As will be described in greater detail with reference to FIGS. 7-9, the circle 41 is of different size at different locations along the cam surfaces for reasons to be explained.

The load cable has first and second intermediate portions 44 and 45 disposed between the inner and outer end portions, and, as best seen in FIG. 3 are in fact a portion of the inner loop 28. The transverse opening 32 is positioned so as to be generally adjacent inner ends 49 and 51 of the shoulders and the intermediate portions of the cable pass along essentially the full length of the shoulders when the device is in the retracted position as shown in FIG. 2. When the device is in a generally expanded position, as shown in FIG. 1, the intermediate portions 44 and 45 of the cable are shown slightly unwrapped from the shoulders. As best seen in FIG. 4, the intermediate portions of the cable have a particular diameter relative to size of the cam member, and the shoulders are recessed slightly to provide seats to receive the cable and are positioned such that, when the load cable rests on the shoulders, the cable and shoulders are within the circle 41 for reasons as will be described.

The cam member has a second transverse opening 54 positioned between the first transverse opening and the inner ends 49 and 51 of the shoulder means. A restraining link 56 passes through the opening 54 and has first and second outer portions 59 and 60 which engage portions of the inner loop 28 of the cable in such a manner as to hold the intermediate portions 44 and 45 of the inner loop closely adjacent the side faces of the cam member. It is important that the load cable does not accidentally slip off the shoulders, and the restraining link 56 serves as a cable restraining means cooperating with the inner loop of the load cable to hold portions of the inner loop closely adjacent the side faces of the cam member to prevent accidental disengagement from the shoulders. As seen in FIG. 4, the link 56 is a strip of metal with openings at the portions 59 and 60 to receive the cable. Alternatively the link can be a loop of relatively thin braided steel cable which closely engages the thicker load cable.

The cam member 16 has a third transverse opening 63 positioned generally adjacent the outer ends 50 and 52 of the shoulders and adjacent a concave intermediate surface 64. The device 10 has a retractor link 65 which has inner and outer end portions 66 and 67. The inner end portion 66 has an inner loop which passes through the third transverse opening 63 and thus cooperates with the cam member. To prevent premature wear of the retractor link 65, clearance grooves 69 to receive adjacent portions of the link 65 extend from the opening 63 to the concave intermediate surface 64 disposed between cam surfaces 17 and 18. The outer end portion 67 cooperates with a finger loop 68 and thus is adapted for gripping by an operator. A guide member 70 has inner and outer portions 72 and 73 which cooperate with the retractor link to form a retraction means as will be described. The guide member has a main rod 76 which can be a relatively stiff cable disposed generally parallel to the load cable 20, with the outer end 73 being secured to the ferrule 30 by a shrink plastic grip means 58, broken outline, thus preventing axial movement between the rod 76 and the outer end portion 22 of the cable. The inner portion 72 of the guide member has a transversely disposed link guide 78 with spaced openings 61 and 62 which cooperate with the intermediate portions 44 and 45 of the cable 20 to hold the portions 44 and 45 at a spacing equal to the shoulder spacing 40. The guide member 70 thus serves as another portion of the cable restraining means cooperating with the inner loop of the load cable to hold portions of the inner loop closely adjacent side faces of the cam member, thus facilitating engagement of the shoulders. Thus portions of the cable adapted to engage the inner and outer ends of the shoulders are restrained to be spaced apart at the shoulder spacing 40 by the restraining link 56 and the guide member 70 respectively. The guide member also cooperates with the inner portion of the retractor link as follows. Preferably, the link guide has a pair of spaced parallel grooves, not shown, which receive the retractor link, and guide it from the third transverse opening 63 towards the finger loop. The outer portion of the retractor link has a guide sleeve 80 adapted to move axially along an outer portion of the guide member 70 so as to maintain generally axial relative movement between the retractor link and the guide means as will be described. The guide sleeve itself is described in greater detail with reference to FIGS. 5 and 6.

In FIG. 1, resilience in the cable 20 rotates the cam member 16 in a first direction per an arrow 71, which causes the intermediate portions 44 and 45 to "unwrap" partially from the shoulders 37 and 38. This rotation forces the cam surfaces 17 and 18 against the crack walls 13 and 14 and the retractor link 65 pulls the finger loop 68 along the guide rod 76 per arrow 74 to a position closer to the link guide 78. In FIG. 2, the loop 68 is moved by the finger in an opposite direction, per an arrow 75, which causes the retractor link to draw the shoulders of the cam member against the cable 20 by rotating the cam member in a second direction per arrow 79. In this fully retracted position of FIG. 2, the intermediate surface 64 of the cam member is closely adjacent the link guide 78. Thus relative axial movement between the retractor link and the guide member applies a couple or rotating force to the cam member 16 so that the cam member rotates, so as to change effective width of the cam member within the crack as will be described. It can be seen that the third transverse opening 63 is spaced from the first transverse opening 32 but this is not necessary and the opening 63 can be omitted and instead the link 65 can pass through the opening 32. This is particularly appropriate for smaller sized devices, where there might otherwise be insufficient metal between the openings 32 and 63.

FIGS. 5 and 6

The guide sleeve 80 includes a tubular member 82 which has a size sufficient to receive as a sliding fit the main guide rod 76, and the intermediate portions 44 and 45 of the load cable 20, disposed as shown in FIG. 5. The finger loop 68 extends generally rigidly from the member 82 and is positioned to permit free sliding of the member 82 along the rod 76.

Figure 7:
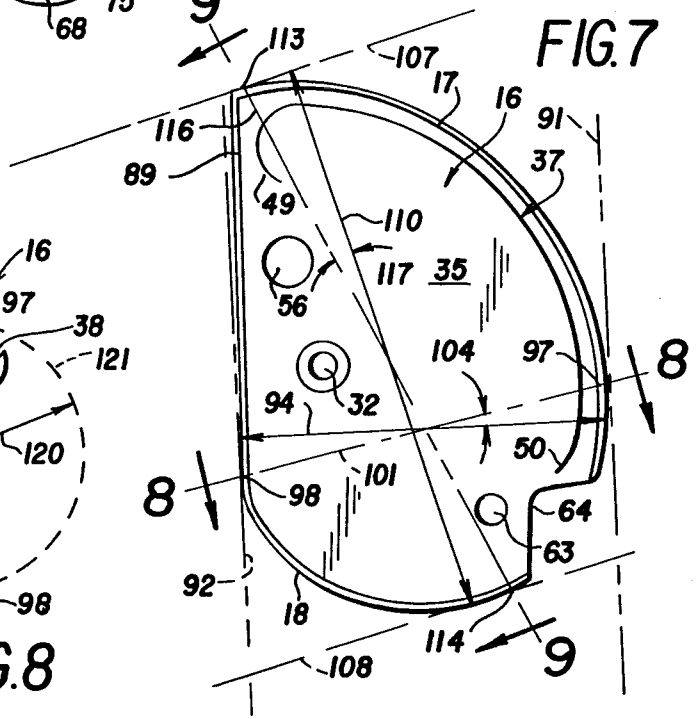
FIG. 7 is a simplified diagram of a cam member of the device inserted within a minimum size crack and a maximum size crack, side walls of the two cracks being shown in broken outline and points of contact with the cam member being designated.
Figure 8:
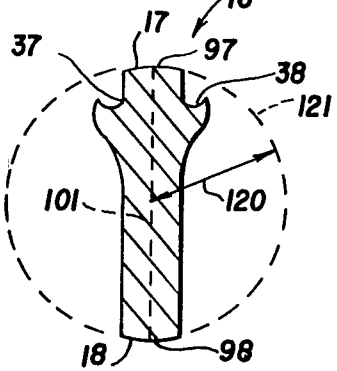
FIG. 8 is a simplified section on line 8—8 of FIG. 7.
Figure 9:
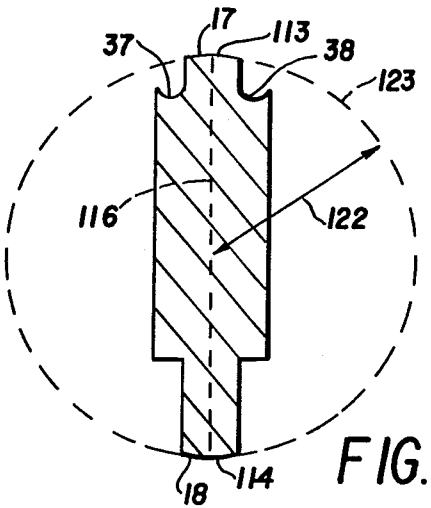
FIG. 9 is a simplified section on line 9—9 of FIG. 7.

FIGS. 7 through 9

Referring mainly to FIG. 7, the cam member 16 has a generally straight clearance surface 89 interconnecting the first and second surfaces 17 and 18 on one side of the cam, while the intermediate surface 64 interconnects the surfaces 17 and 18 on an opposite side of the cam. The clearance surface 89 is provided to permit insertion of the cam member into a gap of minimum width, and usually does not come into direct contact with crack walls when the device is in an operative position.

As previously stated, the "expansion ratio" of a rock anchor is important and the present device has a relatively wide expansion ratio as described briefly below. The cam member is shown fitted in "idealised" cracks having straight parallel walls spaced apart at maximum and minimum spacing.

The cam member 16 is shown fitted between first and second crack walls 91 and 92, which are spaced apart by a crack spacing 94 designated by a perpendicular line defining a crack of minimum width. It can be seen in FIG. 7 that the first and second surfaces 17 and 18 have longitudinal curvatures which are such that the surfaces 17 and 18 contact the first and second walls 91 and 92 at first and second contact points 97 and 98 respectively. A connecting line or contact axis 101 interconnects the contact points as shown and is inclined to the line 94 at a contact angle 104, which is between about 10° and 18° for reasons as will be described.

The cam member 16 is also shown contacting first and second walls 107 and 108 of a crack of maximum width, having a crack spacing 110 designated by a perpendicular line as shown. Again, the first and second cam surfaces 17 and 18 contact the first and second walls 107 and 108 at first and second contact points 113 and 114 respectively. A connecting line or contact axis 116 interconnects the points 113 and 114 and is inclined at a contact angle 117 to the line 110, and the angle 117 is essentially equal to the angle 104. This is assuming that the first and second cam surfaces have curves which have not worn, and that the cracks of minimum and maximum width have essentially parallel side walls. The geometry of the longitudinal curvature of the cam surfaces 17 and 18 can be defined as follows. The surfaces 17 and 18 are so shaped that the contact axis 101, 116 interconnecting the first and second contact points 97, 98, 113, 114 is inclined at the contact angle 104, 117 to the perpendicular line 94, 110 extending generally normally to the crack walls 91, 92, 107 and 108, the angle being essentially constant for all intermediate sized, parallel sided cracks which can accept the cam member.

As was described with reference to FIG. 4, the cam surfaces 17 and 18 are curved transversely so as to fit within a circle disposed transversely to side faces of the cam. As seen in FIG. 7, the section plane on the line 8—8 contains the points of contact 97 and 98 with the crack walls of minimum width, and the section plane on the line 9—9 contains the points of contact 113 and 114 with the crack walls of maximum width. Referring to FIGS. 8 and 9 respectively, a radius 120 of a transverse circle 121 enclosing the cam surfaces 17 and 18 at the contact points 97 and 98 is smaller than a radius 122 of a transverse circle 123 enclosing the cam surfaces 17 and 18 at the contact points 113 and 114. The radii 120 and 122 can be termed "transverse radii" so as to be distinguished from the longitudinal cam surface curvature as viewed in FIG. 7.

The difference in transverse radii of the cam surfaces as described above ensures that each cam surface contacts the crack wall at one position only which appears to reduce a tendency of the device to "walk" out of the crack as will be explained. Also to ensure that the intermediate portions of the load cable lying on the shoulders do not contact side walls of the crack, the shoulder are spaced slightly further from the cam surfaces adjacent the smaller width of the cam member than adjacent the larger width of the cam member. Thus there is adequate clearance for the cable and shoulders at any particular disposition of the cam member within a crack of a particular size. Clearly, there is a gradual change in transverse radii of the cam surfaces 17 and 18 from the inner ends of the shoulders towards the outer ends of the shoulders, so as to accommodate the different requirements as specified above.

In summary, at any location on the cam surfaces, the first and second cam faces are curved transversely (at transverse radii) and the shoulders and load cable are located so as to fit within a circle disposed transversely of the cam faces and containing a line interconnecting points of contact between the cam surfaces and crack walls.

OPERATION

Normally a climber would carry a plurality of anchoring devices according to the invention, ranging in size from the smallest to the largest to accommodate typical cracks on the climb being attempted. When a suitable crack has been located, the climber would select the appropriate sizes anchoring device, in which the actual crack size would be intermediate of the minimum and maximum crack sizes that that particular device could accommodate. A carabiner or rope sling serving as the separate link 26 would normally be threaded through the outer loop 24 and the climber would normally hold the outer link and the intermediate portions of the cable gripped by two fingers in one hand, with a first finger threaded through the loop 68. He would pull back on the loop 68 per the arrow 75, so as to draw the retractor link 65 and rotate the cam member per the arrow 79, so that the intermediate portions 44 and 45 of the cable wrap around and engage the shoulders 37 and 38. Thus, the device assumes the configuration shown in FIG. 2, representing a minimum width condition, to permit easy insertion into the crack.

The cam member 16 is located at a suitable position inside the crack, and the finger loop 68 is released, permitting the cam member to rotate in direction of the arrow 71 due to resilience in the load cable. Further rotation of the cam member is stopped by contact of the first and second cam surfaces 17 and 18 with the first and second crack walls 13 and 14 as shown in FIG. 1. In this position, it can be seen that application of a pulling force on the cable in direction of the arrow 75 tries to "expand" the cam member within the crack, thus augmenting retention of the device in the crack which was initiated by the resilience in the cable.

It can be seen that the inherent resilience of the intermediate portions 44 and 45 of the cable tends to rotate the cam device in the first direction i.e., per arrow 71, when the finger loop 68 is released. It can also be seen that force on the cable 20 in direction of the arrow 75 acts on the shoulders, tending to rotate the cam member in the first direction, thus increasing force acting on the crack walls and augmenting retention of the device within the crack. Thus the resilience of the cable serves as an expansion means cooperating with the cam member and the load cable for rotating the cam member in the first direction, that is the arrow 71, thus tending to augment retention of the device within the crack. It can be seen that the expansion means is characterized by the inner end portion of the load cable being deformed resiliently to engage at least a portion of the shoulder means. Thus a separate spring to expand the device within the crack is eliminated, contrasting with some prior art devices.

Thus it can be seen that the inner end portion of the cable is located relative to the shoulder means so that the cable is deformed resiliently as the intermediate portion thereof engages at least a portion of the shoulder means. This requires that the first transverse opening is non-aligned with the outer portion of the shoulders, i.e. a portion of the shoulders remote from the cable inner portion, so that the cable is deformed as it engages a major portion of the shoulders. This non-alignment distinguishes the invention from some prior art devices where the cable extends cleanly, i.e. without deformation, from an inserted wedge or cam means engaged in the crack. Force from deforming the cable tends to rotate the cam member in the first direction so that forces generated by pulling the cable and deforming the cable over the shoulders rotate the cam in unison so as to augment retention in the crack. This combination of forces is achieved with a very simple device, having fewer parts than prior art devices known to the inventor.

For removal of the device from the crack, the loop 68 is pulled in direction of the arrow 75, thus tending to rotate the cam member in direction of the arrow 79, which wraps the intermediate portions 44 and 45 around the shoulders, reducing effective width, and permitting removal of the device from the crack. It can be seen that the retractor link 65 and finger loop 68 serve as retraction means cooperating with the cam member and the load cable for rotating the cam member in a second direction, namely in direction of the arrow 79, which is opposite to the first direction, so as to decrease forces on the crack walls thus facilitating removal of the device from the crack.

In summary the cable 20 is thus a load sustaining means cooperating with the cam member to permit insertion of the cam member within the crack, and rotation of the cam member so that the cam surfaces engage the crack walls. The retractor link 65 and guide member 70 are a portion of retraction means which cooperate with the cam member to draw the shoulders and the load cable into mutual engagement to reduce overall effective width of the device to permit insertion into, or withdrawal from, the crack.

Similarly to many rock anchor devices, the device of the present invention is a compromise between several factors. The first factor is the expansion ratio of the device, that is the ratio between the minimum and maximum widths 94 and 110, which is typically in the range of 1.0 to 1.5 i.e. about 50% increase. Clearly, to increase versatility of a particular sample of the device, a wide expansion ratio is appropriate provided safety is not compromised. From a study of the geometrical considerations between the crack spacing and profiles of the curves 17 and 18, it has been found that there is a close relationship between the contact angles 104, 117 and the expansion ratio as will be described.

A second factor to be considered is the tendency of the device to "walk" out of the crack, as a result of random rotation or swinging of the device about the contact axes 101,116. This random rotation can occur due to lateral movement of the rope cooperating with the line 26 connecting to the outer loop of the device. In a parallel sided crack, it has been found that the device of the present invention has a tendency to "walk" outwards from the crack, that is in an undesirable direction, due to many reversing cycles causing short lateral rotations or oscillations of the device about the contact axis. This "walking out" of the crack can occur even though the cam surfaces have particular transverse radii which ensure only one contact point for each cam surface. Because the contact axis is always inclined (at the angle 104, 117) to the perpendicular line between the walls, the device appears to have a tendency to tilt or roll slightly in the crack as it rotates about the contact axis. Limited tilting is acceptable because the device can roll along the transverse radii. There also appears to be a relationship between value of the contact angle and the tendency of the device to "walk" out of a crack and thus the contact angle appears to be of major importance when designing the cam member, and a suitable compromise should be reached. The requirement for a large expansion ratio seems to be in conflict with the requirement to reduce the tendency of the device to "walk" out of the crack. If the contact angle is greater than 18°, the expansion ratio might become as high as about 1:1.9, but the device will have a greater tendency to "walk" out of the crack. Conversely, if the contact angle is less than 10°, the device has a negligible tendency to "walk" out of the crack, but the expansion ratio might be as low as about 1:1.4.

A cam member according to the invention can be made from a suitable compression resistant aluminum alloy for lightness, and the load cable is preferably a braided steel cable of sufficient strength and resilience to provide a tendency for the device to expand freely within the crack when the trigger 68 is released. There should be sufficient resilience in the cable to automatically rotate the cam member, and overcome any resistance due to sliding of the loop 68 and guide sleeve 80 along the load cable. The retractor link can be a light braided stainless steel cable of approximately 1mm in diameter, so as to resist wear, although tough synthetic threads can be substituted, provided they are inspected regularly for wear.

The cam member is shown cooperating with the flexible load cable 20 which is efficient as a load sustaining means and is flexible to form loops to cooperate with the cam member and with the separate link 26. However, the same type of cam member can be used singly, or in combination with similar cam members, with alternative load sustaining means to obtain some of the advantages of the present invention.

I claim:

1. An anchoring device for releasably anchoring within a crack in a rock face, the crack having a pair of oppositely facing crack walls, the device including:

(a) a cam member having first and second convexly curved cam surfaces adapted to contact respective walls of the crack, the cam member having shoulder means and cable securing means, (b) a load cable having an inner end portion cooperating with the cable securing means, an outer end portion adapted to cooperate with a separate link, and an intermediate portion disposed between the inner and outer end portions and cooperating with the shoulder means in such a manner as to rotate the cam member in a first direction when the cable is pulled so as to increase force acting on the crack walls, the inner end portion of the cable being located relative to the shoulder means so that the cable is deformed resiliently as the intermediate portion thereof engages at least a portion of the shoulder means, force from deforming the cable tending to rotate the cam means in the first direction so that forces generated by pulling the cable and deforming the cable over the shoulder means act in unison to rotate the cam so as to augment retention of the device within the crack, (c) retraction means cooperating with the cam member and the load cable for rotating the cam member in a second direction which is opposite to the first direction, so as to decrease forces on the crack walls thus facilitating removal of the device from the crack.

2. A device as claimed in claim 1 in which:

(a) the shoulder means is disposed inwardly of, and generally parallel to, a portion of the first cam surface.

3. A device as claimed in claim 1 in which:

(a) the inner end portion of the load cable is formed into an inner loop, (b) the outer end portion is formed into an outer loop to receive the separate link, (c) the cable securing means of the cam member is a first transverse opening which receives the inner loop.

4. A device as claimed in claim 3 in which:

(a) the cam member has a pair of side faces, (b) the shoulder means includes a pair of generally similar curved shoulders which are provided on the opposite side faces of the cam member, are spaced apart at a shoulder spacing, and are spaced equally from an adjacent portion of the first cam surface, (c) the intermediate portion of the load cable is also a portion of the inner loop and is adapted to engage the curved shoulders.

5. An anchoring device as claimed in claim 4 in which:

(a) each shoulder has inner and outer ends, is generally parallel to the first cam surface and extends essentially full length of the first cam surface, (b) the first transverse opening of the cam member is generally adjacent the inner ends of the shoulders so that an extreme portion of the inner loop passes through the transverse opening.

6. An anchoring device as claimed in claim 4 in which:

(a) the first and second cam surfaces are curved transversely so as to fit within a circle disposed transversely of the side faces, the circle being perpendicular to the faces of the cam member and containing a line connecting points of contact of the cam surfaces with the crack walls, (b) the shoulders are positioned so that, when the load cable rests on the shoulders, the cable and shoulders are also within the said circle.

7. An anchoring device as claimed in claim 5 further including:

(a) cable restraining means cooperating with the inner loop of the load cable to hold portions of the inner loop at a spacing generally equal to the shoulder spacing.

8. An anchoring device as claimed in claim 7 in which the cable restraining means includes:

(a) a guide member cooperating with portions of the inner loop generally adjacent the outer ends of the shoulders to hold the portions of the inner loop spaced apart at the shoulder spacing, (b) the cam member having a second transverse opening, (c) a restraining link passing through the second transverse opening, the restraining link having first and second outer portions which engage portions of the inner loop of the cable generally adjacent the inner ends of the shoulders to hold the portions of the inner loop spaced apart at the shoulder spacing.

9. A device as claimed in claim 1 in which:

(a) the retraction means includes a retractor link having inner and outer end portions, the inner end portion cooperating with the cam member and the outer end portion being adapted for gripping by an operator, an outer portion of the retractor link being disposed generally parallel to and adjacent an outer end portion of the load cable.

10. A device as claimed in claim 9 in which:

(a) the retraction means includes a guide member having inner and outer portions, the inner portion guiding the retractor link to permit relative axial movement between the load cable and the retractor link, so that the retractor link acts on the cam member to draw the shoulders and the load cable into mutual engagement to reduce overall width of the device to permit insertion into, or withdrawal from, the crack.

11. A device as claimed in claim 10 in which:

(a) the inner portion of the guide member has link guide to receive the retractor link, (b) the outer portion of the retractor link has a guide sleeve adapted to move axially along an outer portion of the guide member to maintain generally axial relative movement between the retractor link and the guide means as the cam member rotates.

12. A device as claimed in claim 9 in which:

(a) the retractor link has an inner loop, (b) the cam member has a third transverse opening which receives the inner loop of the retractor link, the third transverse opening being positioned to cause the cam member to rotate in response to relative axial movement between the retractor link and the guide member.

13. A device as claimed in claim 1 in which:

(a) the crack walls are generally parallel to each other, (b) the first and second cam surfaces are adapted to contact the crack walls at first and second contact points respectively, (c) the cam surfaces are so shaped that a contact axis interconnecting the first and second contact points is inclined at a contact angle to a perpendicular line extending generally normally to the crack walls, the angle being essentially constant for all parallel sided cracks which can accept the cam member.

14. An anchoring device as claimed in claim 1 in which:

(a) the cable securing means is non-aligned with a portion of the shoulder means remote from the cable securing means, so that the cable is deformed as it engages the shoulder means.

15. An anchoring device as claimed in claim 4 in which:

(a) each shoulder has inner and outer ends, is generally parallel to the first cam surface and extends essentially full length of the first cam surface, (b) the first transverse opening of the cam member is generally adjacent the inner ends of the shoulders so that an extreme portion of the inner loop passes through the transverse opening, (c) the shoulders are curved in such a manner that portions of the shoulders remote from the first transverse opening are non-aligned with the cable securing means, so that the cable is deformed as it engages essentially a major portion of the shoulders.

16. An anchoring device for releasably anchoring within a crack in a rock face, the crack having first and second, generally parallel, opposed crack walls, the device including:

(a) a cam member having first and second convexly curved cam surfaces adapted to contact the first and second walls of the crack at first and second contact points respectively, the curved cam surfaces being so shaped that a contact axis interconnecting the first and second contact points is inclined at a contact angle to a perpendicular line extending generally normally to the crack walls, the angle being essentially constant for all parallel sided cracks which can accept the cam member, (b) load sustaining means, cooperating with the cam member, for permitting insertion of the cam member within the crack, and for rotating the cam member so that the cam surfaces engage the crack walls, with means to permit extraction of the anchoring device from the crack, (c) the cam member having shoulder means adapted to cooperate with the load sustaining means so as to rotate the cam member when the load sustaining means is loaded in such a direction as to increase force on the crack walls, so as to retain the device within the crack.

17. An anchoring device as claimed in claim 16 in which:

(a) the cam member has a pair of side faces, (b) the first and second cam surfaces are curved transversely so as to fit within a circle disposed transversely of the side faces, the circle being perpendicular to the side faces of the cam and containing the contact axis.

18. An anchoring device as claimed in claim 16 in which:

(a) the angle between the contact axis interconnecting the contact points and the perpendicular line extending normally to the crack walls is within a range of between 10 degrees and 18 degrees.

19. An anchoring device as claimed in claim 16 in which:

(a) the shoulder means includes a pair of generally similar curved shoulders which are provided on the opposite side faces of the cam member, are spaced apart at a shoulder spacing, and are spaced equally from an adjacent portion of the first cam surface, (b) the shoulders are disposed inwardly of, and generally parallel to, a portion of the first cam surface.

20. An anchoring device as claimed in claim 19 in which:

(a) the first and second cam surfaces are curved transversely so as to fit within a circle disposed transversely of the side faces, the circle being perpendicular to the faces of the cam member and containing a line connecting points of contact of the cam surfaces with the crack walls, (b) the shoulders are positioned so that, when the load cable rests on the shoulders, the cable and shoulders are also within the said circle.

* * * * *